US008778859B2

(12) United States Patent
Rajewski et al.

(10) Patent No.: US 8,778,859 B2
(45) Date of Patent: Jul. 15, 2014

(54) LUBRICANT USEFUL FOR IMPROVING THE OIL SEPARATION PERFORMANCE OF A VAPOR COMPRESSION SYSTEM

(75) Inventors: Thomas E. Rajewski, Auburn, MI (US); Kenneth C. Lilje, Midland, MI (US); John C. Tolfa, Midland, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 1486 days.

(21) Appl. No.: 10/529,955

(22) PCT Filed: Oct. 1, 2003

(86) PCT No.: PCT/US03/30978

§ 371 (c)(1),
(2), (4) Date: Jan. 9, 2006

(87) PCT Pub. No.: WO2004/031331

PCT Pub. Date: Apr. 15, 2004

(65) Prior Publication Data

US 2006/0166843 A1 Jul. 27, 2006

Related U.S. Application Data

(60) Provisional application No. 60/415,955, filed on Oct. 3, 2002.

(51) Int. Cl.
*C10M 143/00* (2006.01)
*C10M 143/06* (2006.01)

(52) U.S. Cl.
USPC ..... 508/591; 508/459; 62/6

(58) Field of Classification Search
USPC ..... 508/459, 591; 62/6
See application file for complete search history.

(56) References Cited

U.S. PATENT DOCUMENTS

| | | | | |
|---|---|---|---|---|
| 5,102,567 | A | 4/1992 | Wolf | 252/46.6 |
| 5,622,924 | A * | 4/1997 | Sakai et al. | 508/469 |
| 5,629,273 | A * | 5/1997 | Hauenstein | 508/208 |
| 5,723,417 | A * | 3/1998 | Kitahara et al. | 508/455 |
| 6,322,719 | B2 * | 11/2001 | Kaneko et al. | 252/68 |
| 6,410,492 | B1 | 6/2002 | Shimomura et al. | 508/485 |
| 6,656,887 | B2 * | 12/2003 | Yagishita et al. | 508/371 |
| 2003/0127622 | A1 * | 7/2003 | Kawaguchi et al. | 252/68 |

FOREIGN PATENT DOCUMENTS

| | | | |
|---|---|---|---|
| EP | 1085077 | A | 3/2001 |
| EP | 1085077 | A1 * | 3/2001 |
| FR | 2753986 | | 4/1998 |
| GB | 2149814 | A | 6/1985 |
| GB | 2149814 | A * | 6/1985 |
| JP | 62039694 | A * | 2/1987 |
| JP | 11335684 | A * | 12/1999 |

OTHER PUBLICATIONS

Corresponding International Publication No. WO 2004/031331 and Search Report; International Publication Date: Apr. 15, 2004.
Derwent Abstract Accession No. 1998-219592/200116—French Patent No. 2753986A1 (Elf Antar France, Apr. 3, 1998).

* cited by examiner

*Primary Examiner* — Jim Goloboy
(74) *Attorney, Agent, or Firm* — Samuel B. Laferty

(57) ABSTRACT

Polymeric additives are disclosed for compressor lubricants which can reduce the tendency of the lubricant to become entrained in compressed gases and be carried forward as fine dispersed droplets in compressed gas systems such as compressed air, natural gas, and compression refrigeration systems.

4 Claims, No Drawings

LUBRICANT USEFUL FOR IMPROVING THE OIL SEPARATION PERFORMANCE OF A VAPOR COMPRESSION SYSTEM

This application claims priority from PCT Application Serial No. PCT/US2003/030978 filed on Oct. 1, 2003, which claims the benefit of U.S. Provisional Application No. 60/415,955 filed on Oct. 3, 2002.

FIELD OF INVENTION

The invention relates to polymeric additives for compressor lubricants that can reduce the amount of lubricant carryover as mist in compressed gas from the discharge side of the compressor. In refrigeration systems the compressed gas is a refrigerant. In other systems the compressed gas could be a fuel e.g. natural gas or a mixture of gases e.g. air.

BACKGROUND OF THE INVENTION

Polymers have been used in a wide variety of lubricants to decrease the temperature sensitivity of the lubricant viscosity (e.g. maintain higher lubricant viscosity at higher temperatures). While the viscosity of some lubricants are not particularly sensitive to temperature, the viscosity of other fluids is very dependent on the temperature. If a lubricant's viscosity has little sensitivity to temperature it is said to have a high viscosity index (HVI).

There is very little to suggest the use of polymers (e.g. those used as viscosity index modifiers) to eliminate mist in lubricants for a compression system.

SUMMARY OF THE INVENTION

A polymeric additive soluble in the lubricant is added thereto to suppress the tendency of the oil(s) in the lubricant to be dispersed as small droplets in a compressed gas stream. This can be characterized as anti-mist or anti-smoke depending on whether the small lubricant droplets are considered to be mist or, as suspended, smoke. It is important that the polymeric additive have good solubility in both the lubricant and many solutions within the system of the lubricant and the compressed gas. The polymeric additive should also be resistant to mechanical (e.g. shear) or thermal chain scission so that the molecular weight of the polymeric additive isn't dramatically reduced during the useful life of the lubricant. Useful polymeric additives, since they need favorable interaction with the lubricant and the compressed gas, will partially depend on the chemical composition of the lubricant and partially depend on the composition of the compressed gas. The incorporation of a large polymeric material in a lubricant formulation can potentially change the interfacial tension between the lubricant and the gas. The polymeric additives have a large effect on the reduction of carryover through a mechanical separation device and favorably influence lubricant droplet size. Useful polymeric additives include polyolefins such as polyisobutlyene and acrylate polymers such as ethylene-vinyl ester copolymers or polymethacrylate. Copolymers containing a variety of other monomers in lesser amounts are also desirable providing that stability of molecular weight is achieved and the additives are soluble in the lubricant.

DETAILED DESCRIPTION OF THE INVENTION

The invention is a combination of a lubricant, a polymeric additive and a compressible gas whereby the invention fluid (lubricant or lubricant and compressed gas) provides better (more efficient) lubricant/gas separation performance than the lubricant/gas provides without the additive.

A related application directed to compression systems with reduced equipment requirements for removing finely divided lubricants, classified as an aerosol, entrained in the compressed gas exiting the compressor are described in a copending patent application entitled "Compressor Systems for Use with Smokeless Lubricant" having US Serial No. 20020263871, published as US 2004065110(A1) and assigned to York International Corp. of Waynesboro, Pa., was filed on the same day as the present application.

Vapor compression systems operate with various styles of compressors (eg. reciprocating, rotary vane, rotary screw, scroll, etc.). It is desirable to maximize the separation of the lubricant from the compressed gas as the combination leaves the compressor. Often mechanical separators are used to accomplish better separation of the lubricant and compressed gas. Mechanical oil separators add complexity and cost to the vapor compression system. It would be beneficial if the oil (lubricant) separation system could be 1) physically smaller, 2) less complex (to facilitate manufacture and maintenance), and 3) more efficient in removing the lubricant from the compressed gas.

Oil carry over can result in reduced efficiency in closed systems, such as refrigeration systems due to flow constrictions and pressure drops associated with lubricant separator systems. Carryover can also result in operational problems in industrial applications. Examples include: A) in systems to compress air—oil carry over contaminates breathing air, fouls pneumatically operated equipment and contaminates air drier systems, creating a hazardous waste; B) in systems to compress hydrocarbons—compressor oil carryover into gas burning turbines results in many inefficiencies and damage to turbine blades; C) in systems to compress process gases—compressor oil carryover can contaminate expensive catalyst systems and process materials; D) in refrigeration systems—compressor oil carry over into the low temperature heat exchanger area caused loses in heat transfer efficiency from the oil film that develops on the cold surfaces.

The compositions of this invention enable the system to achieve or improve on one or all of the above described problems.

The current invention is a combination of a lubricant basestock (including typical additives to provide enhanced lubricant properties, if needed), a polymeric additive chosen to improve oil separation properties and a compressible gas.

Lubricant basestocks include: carboxylate esters (e.g. diesters, triesters, polyol esters, etc.); synthetic hydrocarbons (e.g. polyalphaolefin and various products from gas to conversion such as Fischer-Tropsch products); mineral oils (eg. hydrocracked mineral oils, hydrotreated mineral oils, paraffinic mineral oils, naphthenic mineral oils); polyalkylene glycols also known as poly(oxyalkylene) or PAG, (eg. monofunctional polyglycols, di-functional polyglycols, ester or ether endcapped polyglycols, etc.); and alkyl aromatics (e.g. alkylated benzene and alkylated naphthalene) or blends thereof in various proportions.

Oil separation (polymeric) additives include intermediate weight average molecular weight (eg. 600-1,000,000 amu) polymers, more preferably from about 70,000 to about 350,000 and still more preferably from about 100,000 to about 250,000 miscible with the desired lubricant and compatible with the mixture of gas and lubricant. Desirably the polymeric additive is not an acrylate polymer of weight average molecular weight of 70,000 or less when the oil of lubricating viscosity is a mineral oil, synthetic hydrocarbon, alkyl benzene or alkyl naphthalene. Correct molecular weight and compatibility are indicated by an ability to reduce by 50 wt. % or more the suspended oil droplets as compared to a control of the same oil sheared under the same conditions in the absence of the polymeric modifier. This type of data is shown in the examples. Typical treat level is from about 0.02 or 0.1% to 1, 5, 20 or 30% by weight based on the weight of the formulated lubricant. A preferred range is from about 0.1 to about 5 weight percent. Examples of additives include: polyolefins, polybutenes; polyacrylates (including methacrylate monomers and repeat units therefrom); olefin/acrylate copolymers; olefin/vinyl acetate copolymers); etc. These polymers can include a wide variety of other co-polymerizable monomers that do not adversely affect compatibility of the polymeric additives with the lubricating oil and do not affect function as mist suppressors. Typical monomers include olefins of 2 to 8 carbon atoms, e.g. ethylene, propylene, and isobutylene; acrylates of 4 to 20 carbon atoms; acrylic acid and alkyl substituted acrylic acid; unsaturated polycarboxylic acids; vinyl acetate; amides of 3 to 10 carbon atoms; etc.

Compressible gasses include chlorofluorocarbons (CFC), hydrochlorofluorocarbons (HCFC) and hydrofluorocarbons (HFC) refrigerants (e.g. R-12, R-22, R-134a and many others); low molecular weight hydrocarbons (e.g. methane, ethane, isobutene, ethylene, propylene, etc. and combinations thereof such as occur in wells or refinery streams); natural gas; ammonia; carbon dioxide; air; various process gases in chemical plants; etc. A preferred use is compressible gases for use in compression refrigeration equipment.

The combination of the lubricant basestock, polymeric additive, and compressible gas results in improved separation of the lubricant from the compressible gas with minimal necessity for mechanical or other oil separators. This is evidenced by measurements of lubricant particulate (mg/m$^3$) in the gas of a test spray chamber. This key property enables the system to have smaller and less complex (minimal and/or simplified) separation equipment. This will afford a lower cost, smaller sized oil separator and more efficient system operation (lower energy costs for operation).

EXAMPLES

The concept of reducing fine lubricant dispersions in a gas was proven using the various lubricants with appropriate mist suppressant incorporated therein. The gas used in the experiment below was air. The samples were 300 mL at 60° C. The smoke or mist was generated by shearing the sample with a rotary shear of 7500 rpm which on conventional oil samples generated a cloud of suspended oil particles in the gas phase. After steady-state conditions were achieved, a reading was taken and additional measurements were made every minute for five minutes thereafter for a total of 6 data points/sample. Measurements of particulate in the atmosphere above the sample were made using the DataRAM analyzer for suspended oil droplets and are reported in mg/m$^3$ of gas.

TABLE 1

Data on mist suppression by various polymer in oil

| Example | Description | Mist in mg/m$^3$ |
|---|---|---|
| A | ISO-VG 68 (polyol ester) + 1% FP-0111091 (ethylene-vinyl ester copolymer) | 40 |
| B | ISO-VG 68 Hydrotreated mineral oil + 1% Visc I-300 + 1% V-422 (polyisobutylene) | 2.1 |

TABLE 1-continued

Data on mist suppression by various polymer in oil

| Example | Description | Mist in mg/m$^3$ |
|---|---|---|
| C | ISO-VG 68 Hydrotreated mineral oil + 1% Visc I-300 + 1% V-188 (polyolefin) | 1.8 |
| Control D | ISO-VG 68 Hydrotreated Mineral oil + 2% Visc I-300 | 79 |
| Control E | ISO-VG 68 Hydrotreated mineral oil | 119 |
| Control F | ISO-VG 68 Hydrotreated mineral oil with 1% Visc I-300 (polymethacrylate) | 78 |
| Control H | ISO-VG 68 (polyol ester) without additive | 137 |

ISO-VG 68 is indicative of 68 cSt viscosity at 40 C. Visc I-300 is Viscoplex I-300 a trademarked product of RohMax Additives GmbH a specialty acrylics business unit of DeGussa. All other additives in the table are available from Functional Products of Cleveland, Ohio under the sample identifiers (e.g. FP-0111091, V-188, V-422). The polyol ester oil was a polyol ester from technical grade pentaerythritol esterified with linear C7, C8, C10 and 3,5,5-trimethylhexanoic carboxylic acids resulting in the specified viscosity.

This product (blend of lubricating oil and polymeric additive) can be used in vapor compressions systems to increase the oil separation performance of the system. Current oil separators could be made smaller, could operate with lower cost separation elements, could give higher levels of oil separation.

As used herein, the expression "consisting essentially of" permits the inclusion of substances that do not materially affect the basic and novel characteristics of the composition under consideration i.e. ability of oil to provide a lubricating film and to separate from a gas phase (optionally condensed into a liquid) with minimal oil separation equipment. Comprising means having at least the listed elements and optionally a variety of other unnamed elements that may or may not affect the basic characteristics of the composition.

What is claimed is:

1. A gas compressor and a lubricant therein wherein the lubricant comprises;

a) at least one oil of lubricating viscosity, b) from about 0.1 to about 5 weight percent of a polymeric additive having a weight average molecular weight from 70,000 to 350,000 amu and soluble in said lubricant at those weight percentages and wherein said polymeric additive is selected from the group consisting of a polyisobutylene, other polyolefin homopolymer and polyolefin copolymer, c) optionally lubricant additives selected from antioxidants, friction modifiers, dispersants, detergents, basicity reserve agents, dyes, and corrosion inhibitors, and d) further including a gas selected from the group consisting of, carbon dioxide, ammonia, and air within said compressor.

2. A gas compressor and a lubricant therein according to claim 1, wherein said lubricant comprises a mineral oil, synthetic hydrocarbon, alkyl benzene, or alkyl naphthalene.

3. A gas compressor and a lubricant therein according to claim 1, wherein said lubricant comprises at least 50 weight percent of hydrocarbon lubricants selected from polyalphaolefins, mineral oil, and alkyl aromatics.

4. In a method of compressing a gas using a mechanical compressor lubricated with a lubricant, the improvement comprising adding from about 0.1 to about 5 weight percent of a weight average molecular weight from 70,000 to 350,000 amu polymer that is soluble in said lubricant to said lubricant to suppress the tendency of said lubricant to be carried away from the compressor in the compressed gas output and wherein said polymer is a polyisobutylene or other polyolefin homopolymer or polyolefin copolymer further including, carbon dioxide, ammonia, or air within said compressor.

* * * * *